US006565953B2

(12) United States Patent
Landry-Coltrain et al.

(10) Patent No.: US 6,565,953 B2
(45) **Date of Patent: *May 20, 2003**

(54) INK JET RECORDING ELEMENT

(75) Inventors: Christine J. Landry-Coltrain, Fairport, NY (US); David M. Teegarden, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 110 days.

This patent is subject to a terminal disclaimer.

(21) Appl. No.: 09/726,373

(22) Filed: Nov. 30, 2000

(65) Prior Publication Data

US 2002/0094418 A1 Jul. 18, 2002

(51) Int. Cl.[7] ..... B41M 005/00
(52) U.S. Cl. ..... 428/195
(58) Field of Search ..... 428/195

(56) References Cited

U.S. PATENT DOCUMENTS 4,785,313 A 11/1988 Higuma et al.
4,832,984 A 5/1989 Hasegawa et al.
6,177,181 B1 * 1/2001 Hamada et al.
6,211,304 B1 * 4/2001 Farooq

FOREIGN PATENT DOCUMENTS

EP 0 940 427 A1 8/1999

* cited by examiner

*Primary Examiner*—Pamela R. Schwartz
(74) *Attorney, Agent, or Firm*—Harold E. Cole; Paul A. Leipold

(57) ABSTRACT

An ink jet recording element comprising a support having thereon in order:

a) a hydrophilic, fluid-absorbing layer, and b) an image-receptive layer capable of retaining an ink jet image, the image-receiving layer comprising an open-pore membrane of a mixture of a water-insoluble polymer and a water-absorbent polymer, the mixture containing at least about 25% by weight of the water-absorbent polymer.

19 Claims, No Drawings

INK JET RECORDING ELEMENT

CROSS REFERENCE TO RELATED APPLICATION

Reference is made to the following commonly assigned, copending U.S. patent applications:

Ser. No. 09/626,588, filed Jul. 27, 2000, of Landry-Coltrain et al. entitled "Ink Jet Printing Method" now U.S. Pat. No. 6,481,843;

Ser. No. 09/627,052, filed Jul. 27, 2000, of Landry-Coltrain et al. entitled "Ink Jet Printing Method" now U.S. Pat. No. 6,464,351;

Ser. No. 09/626,752, filed Jul. 27, 2000, of Landry-Coltrain et al. entitled "Ink Jet Recording Element" now U.S. Pat. No. 6,497,941;

Ser. No. 09/626,883, filed Jul. 27, 2000, of Landry-Coltrain et al. entitled "Ink Jet Recording Element" now U.S. Pat. No. 6,503,607; and Ser. No. 09/727,227, filed of even date herewith, of Landry-Coltrain et al. entitled "Ink Jet Printing Method" now U.S. Pat. No. 6,497,481.

FIELD OF THE INVENTION

This invention relates to an ink jet recording element, more particularly to a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer. The ink-receiving layer may be a porous layer which imbibes the ink via capillary action or a polymer layer which swells to absorb the ink.

Ink jet prints, prepared by printing onto ink jet recording elements, are subject to environmental degradation. They are especially vulnerable to water smearing and light fade. For example, since ink jet dyes are water-soluble, they can migrate from their location in the image layer when water comes in contact with the receiver after imaging. Highly swellable hydrophilic layers can take an undesirably long time to dry, slowing printing speed, and will dissolve when left in contact with water, destroying printed images. Porous layers speed the absorption of the ink vehicle, but often suffer from insufficient gloss and severe light fade. Porous layers are also difficult to coat without cracking. The support for the ink receiving layers is typically either porous or non-porous. When it is porous, the support itself can absorb non-imaging ink components such as water, solvents, and humectants, so that the ink receiving layer thickness can be minimized. However, when the support itself is non-porous, the ink receiving layer thickness must be great enough to absorb all the ink rapidly in order to prevent degradation of the image by dye smear during printing.

EP 940,427 discloses a method for making a microporous film for an ink jet recording element in which a hydrophobic polymer and a second hydrophilic polymer or copolymer of N-vinylpyrrolidone is dissolved in a certain solvent system, partially dried, and then washed to extract at least 50% by weight of the second polymer. The amount of the hydrophobic polymer to the second hydrophilic polymer is stated as 2:1–1:3. This reference also discloses the addition of a mordant to the polymer mixture. However, this reference does not disclose the use of a fluid-absorbing layer, so that the element has a problem in that it has a limited ink-absorbing capacity.

U.S. Pat. Nos. 4,785,313 and 4,832,984 disclose a two-layer ink jet receiving element wherein the layer adjacent the support is an image receiving layer and the outermost layer is an ink-transporting layer. However, there is a problem with this receiving element due to the fact that the ink-retaining layer is underneath the ink-transporting layer, which would scatter light, thus lowering the optical density.

It is an object of this invention to provide an ink jet recording element which will provide improved ink uptake speed and capacity. Another object of the invention is to provide an ink jet recording element having a receiving layer that when printed upon has an excellent image quality. Still another object of the invention is to provide an ink jet recording element having a receiving layer wherein the printed image has improved water fastness. Yet still another object of the invention is to provide an ink jet recording element having improved ink absorbing capacity and drying rate when the support is non-porous or highly water resistant.

SUMMARY OF THE INVENTION

These and other objects are provided by the present invention comprising an ink jet recording element comprising a support having thereon in order:

a) a hydrophilic, fluid-absorbing layer, and b) an image-receptive layer capable of retaining an ink jet image, the image-receptive layer comprising an open-pore membrane of a mixture of a water-insoluble polymer and a water-absorbent polymer, the mixture containing at least about 25% by weight of the water-absorbent polymer.

By use of the invention, a recording element is obtained which will provide improved ink uptake speed and capacity, and when printed upon, has an excellent image quality and improved water fastness.

DETAILED DESCRIPTION OF THE INVENTION

In order for the image-receptive layer of the invention to be sufficiently porous, the water-insoluble polymer must be coated from a solvent mixture combination such that an open-pore membrane structure will be formed when the solution is coated and dried, in accordance with the known technique of dry phase inversion. In a preferred embodiment, the formation of an open-pore membrane is accomplished by using a mixture of a good and poor solvent for the water-insoluble polymer. In this embodiment, the poor solvent has a boiling point that is higher than that of the good solvent. When the solution is coated or cast onto a support and dried, the good solvent evaporates faster than the poor solvent, forming the membrane structure of the layer when the polymer phase separates from the solvent mixture. The open-pore structure results when the good solvent and poor solvent are removed by drying.

The water-insoluble polymer that can be used in the image-receptive layer of the invention may be, for example, a cellulose ester such as cellulose diacetate, cellulose triacetate, cellulose acetate propionate or cellulose acetate butyrate, cellulose nitrate, polyacrylates such as poly(methyl methacrylate), poly(phenyl methacrylate) and copolymers with acrylic or methacrylic acid, or sulfonates, polyesters, polyurethanes, polysulfones, urea resins, melamine resins, urea-formaldehyde resins, polyacetals, polybutyrals, epoxies and epoxy acrylates, phenoxy resins, polycarbonates, vinyl acetate polymers and copolymers, vinyl chloride-vinyl acetate copolymers, vinyl chloride-vinyl acetate-vinyl-alcohol copolymers, vinyl chloride-vinyl acetate-maleic acid polymers, vinyl chloride-vinylidene chloride copolymers, vinyl chloride-acrylonitrile copolymers, acrylic ester-acrylonitrile copolymers, acrylic ester-vinylidene chloride copolymers, methacrylic ester-styrene copolymers, butadiene-acrylonitrile copolymers, acrylonitrile-butadiene-acrylic or methacrylic acid copolymers, or styrene-butadiene copolymers. Cellulose ester derivatives, such as cellulose diacetates and triacetates, cellulose acetate propionate, cellulose acetate butyrate, cellulose nitrate, and mixtures thereof are preferred.

The water-absorbent polymer that can be used in the image-receptive layer of the invention may be, for example, polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcohol-containing copolymers, poly (vinyl methyl ether), poly(vinyl ethyl ether), poly(ethylene oxide), hydroxyethylcellulose, hydroxypropylcellulose, hydroxypropylmethylcellulose, methylcellulose, and mixtures thereof. As noted above, the water-absorbent polymer is present in an amount of at least about 25% by weight of the mixture. If the water-absorbent polymer is too high, for example, greater than about 75% by weight, then the open pore membrane structure is not formed. If the water-absorbent polymer is less than about 25% by weight, then poor image density is obtained.

The hydrophilic, fluid-absorbing layer useful in the invention may be gelatin, acetylated gelatin, phthalated gelatin, oxidized gelatin, chitosan, poly(alkylene oxide), a poly (vinyl alcohol), sulfonated polyester, partially hydrolyzed poly(vinyl acetate/vinyl alcohol), poly(acrylic acid), poly(1-vinyl pyrrolidone), poly(sodium styrene sulfonate), poly(2-acrylamido-2-methane sulfonic acid), polyacrylamide or mixtures thereof. In a preferred embodiment of the invention, the hydrophilic, fluid-absorbing layer is gelatin. In another preferred embodiment of the invention, the hydrophilic, fluid-absorbing layer is porous, comprising particulates such as an inorganic oxide or an organic polymer. For example, the porous, particulate-containing layer may be barium sulfate, calcium carbonate, clay, silica or alumina, or mixtures thereof.

In a preferred embodiment of the invention, the hydrophilic, fluid-absorbing layer has a thickness of about 1 $\mu$m to about 40 $\mu$m and the image-receptive layer has a thickness of about 2 $\mu$m to about 50 $\mu$m.

In another preferred embodiment of the invention, the image-receptive layer contains at least about 7% by weight of a mordant comprising a polymer or copolymer containing a quaternized nitrogen moiety. The mordant serves to improve the fixability of an ink jet image, thereby improving water fastness and smear. The mordant polymer can be a soluble polymer, or a crosslinked dispersed microparticle.

The mordant polymer or copolymer containing a quaternized nitrogen moiety which is useful in the invention can contain other comonomers such as, for example, styrenics, acrylates, imidazoles, vinylpyridines, etc. Examples of specific mordants include poly(styrene-co-1-vinylimidazole-co-1-vinyl-3-benzylimidazolium chloride), poly(styrene-co-1-vinylimidazole-co-1-vinyl-3-hydroxyethyl-imidazolium chloride), poly(styrene-co-1-vinylimidazole-co-1-vinyl-3-benzylimidazolium chloride-co-1-vinyl-3-hydroxyethylimidazolium chloride), poly (vinylbenzyltrimethylammonium chloride-co-divinylbenzene), poly(ethyl acrylate-co-1-vinylimidazole-co-1-vinyl-3-benzylimidazolium chloride), or poly(styrene-co-4-vinylpyridine-co-4-hydroxyethyl-1-vinylpyridinium chloride).

In a preferred embodiment of the invention, the quaternary nitrogen moiety is a salt of trimethylvinylbenzylammonium, benzyldimethylvinylbenzylammonium, dimethyloctadecylvinylbenzylammonium, 1-vinyl-3-benzylimidazolium, 1-vinyl-3-hydroxyethylimidazolium or 4-hydroxyethyl 1-vinylpyridinium. Preferred counter ions which can be used include chlorides or other counter ions as disclosed in U.S. Pat. Nos. 5,223,338; 5,354,813; and 5,403,955, the disclosures of which are hereby incorporated by reference. The hydrophilic, fluid-absorbing layer useful in the invention may also contain mordant polymers.

The choice of a good and poor solvent for the water-insoluble polymer will be effectively determined by the specific choice of polymer. The good solvent that can be used in the invention includes alcohols such as methanol, ethanol, n-propyl alcohol, isopropyl alcohol, isobutyl alcohol, Dowanol® solvents, glycols, ketones such as acetone, 2-butanone, 3-pentanone, cyclopentanone, and cyclohexanone, ethyl acetate, methylacetoacetate, diethylether, tetrahydrofuran, acetonitrile, dimethylformamide, dimethylsulfoxide, pyridine, chlorinated solvents such as methylene chloride, chloroform, carbon tetrachloride, and dichloroethane, hexane, heptane, cyclopentane, cyclohexane, toluene, xylenes, nitrobenzene, and mixtures thereof.

The poor solvent that can be used in the invention may be, for example, alcohols such as ethanol, n-propyl alcohol, isopropyl alcohol, isobutyl alcohol, 2-methyl-2,4-pentanediol, and Dowanol® solvents, glycols, ketones such as 2-butanone, 3-pentanone, cyclopentanone, and cyclohexanone, ethyl acetate, methylacetoacetate, diethylether, tetrahydrofuran, acetonitrile, dimethylformamide, dimethylsulfoxide, pyridine, chlorinated solvents such as carbon tetrachloride, and dichloroethane, hexane, heptane, cyclopentane, cyclohexane, toluene, xylenes, nitrobenzene, water, and mixtures thereof.

Since the image recording element may come in contact with other image recording articles or the drive or transport mechanisms of image recording devices, additives such as filler particles, surfactants, lubricants, crosslinking agents, matte particles and the like may be added to the element to the extent that they do not degrade the properties of interest.

Filler particles may be used in the open-pore membrane, the hydrophilic, fluid-absorbing layer, or both. Examples of filler particles are silicon oxide, fumed silica, silicon oxide dispersions such as those available from Nissan Chemical Industries and DuPont Corp., aluminum oxide, fumed alumina, calcium carbonate, barium sulfate, barium sulfate mixtures with zinc sulfide, inorganic powders such as $\gamma$-aluminum oxide, chromium oxide, iron oxide, tin oxide, doped tin oxide, alumino-silicate, titanium dioxide, natural or synthetic clay particles, organic particles, such as polystyrene matte beads, highly crosslinked organic polymer particles derived primarily from styrene, acrylates, or methacrylates, mixtures of these monomers, or mixtures with other monomers.

A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse® sold by Zeneca, Inc. (ICI). Preferred filler particles are silicon oxide, aluminum oxide, calcium carbonate, and barium sulfate. Preferably, these filler particles have a median diameter less than 1.0 $\mu$m. The filler particles can be present in the amount from about 0 to 80 percent of the total solids in the dried open-pore membrane layer, most preferably in the amount from about 0 to 40 percent.

The open-pore membrane layer, the hydrophilic, fluid-absorbing layer, or both, may include lubricating agents. Lubricants and waxes useful either in the open-pore membrane layer or on the side of the element that is opposite the open-pore membrane layer include, but are not limited to, polyethylenes, silicone waxes, natural waxes such as carnauba, polytetrafluoroethylene, fluorinated ethylene propylene, silicone oils such as polydimethylsiloxane, fluorinated silicones, functionalized silicones, stearates, polyvinylstearate, fatty acid salts, and perfluoroethers. Aqueous or non-aqueous dispersions of submicron size wax particles such as those offered commercially as dispersions of polyolefins, polypropylene, polyethylene, high density polyethylene, microcrystalline wax, paraffin, natural waxes such as carnauba wax, and synthetic waxes from such companies as, but not limited to, Chemical Corporation of America (Chemcor), Inc., Michelman Inc., Shamrock Technologies Inc., and Daniel Products Company, are useful.

The open-pore membrane layer, the hydrophilic, fluid-absorbing layer, or both, may include coating aids and surfactants such as nonionic fluorinated alkyl esters such as FC-430®, FC-431®, FC-10®, FC-171® sold by Minnesota Mining and Manufacturing Co., Zonyl® fluorochemicals such as Zonyl-FSN®, Zonyl-FTS®, Zonyl-TBS®, Zonyl-BA® sold by DuPont Corp.; other fluorinated polymer or copolymers such as Modiper F600® sold by NOF Corporation, polysiloxanes such as Dow Corning DC 1248®, DC200®, DC510®, DC 190® and BYK 320®, BYK 322®, sold by BYK Chemie and SF 1079®, SF1023®, SF 1054®, and SF 1080® sold by General Electric, and the Silwet® polymers sold by Union Carbide; polyoxyethylene-lauryl ether surfactants; sorbitan laurate, palmitate and stearates such as Span® surfactants sold by Aldrich; poly (oxyethylene-co-oxypropylene) surfactants such as the Pluronic® family sold by BASF; and other polyoxyethylene-containing surfactants such as the Triton X® family sold by Union Carbide, ionic surfactants, such as the Alkanol® series sold by DuPont Corp., and the Dowfax® family sold by Dow Chemical.

The open-pore membrane layer, the hydrophilic, fluid-absorbing layer, or both, may include crosslinking agents, such as organic isocyanates such as tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate; aziridines such as taught in U.S. Pat. No. 4,225,665; ethyleneimines such as Xama-7® sold by EIT Industries; blocked isocyanates such as CA BI-12 sold by Cytec Industries; melamines such as methoxymethyhnelamine as taught in U.S. Pat. No. 5,198,499; alkoxysilane coupling agents including those with epoxy, amine, hydroxyl, isocyanate, or vinyl functionality; Cymel® crosslinking agents such as Cymel 300®, Cymel 303®, Cymel 1170®, Cymel 1171® sold by Cytec Industries; and bis-epoxides such as the Epon® family sold by Shell. Other crosslinking agents include compounds such as aryloylureas, aldehydes, dialdehydes and blocked dialdehydes, chlorotriazines, carbamoyl pyridiniums, pyridinium ethers, formamidinium ethers, and vinyl sulfones. Such crosslinking agents can be low molecular weight compounds or polymers, as discussed in U.S. Pat. No. 4,161,407 and references cited.

In the present invention, the support can be either transparent or opaque. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as polyethylene terephthalate, polyethylene naphthalate, poly-1,4-cyclohexanedimethylene terephthalate, polybutylene terephthalate, and copolymers thereof; polyimides; polyamides; polycarbonates; polystyrene; polyolefins, such as polyethylene or polypropylene; polysulfones; polyacrylates; polyether imides; and mixtures thereof. The papers listed above include a broad range of papers, from high end papers, such as photographic paper to low end papers, such as newsprint.

The support used in the invention may employ an undercoat or an adhesive layer such as, for example, a vinylidene chloride-methyl acrylate-itaconic acid terpolymer or a vinylidene chloride-acrylonitrile-acrylic acid terpolymer. Other chemical adhesives, such as polymers, copolymers, reactive polymers or copolymers, that exhibit good bonding between the hydrophilic, fluid-absorbing layer and the support can be used. Other methods to improve the adhesion of the layer to the support include surface treatment such as by coronadischarge, plasma-treatment in a variety of atmospheres, UV treatment, etc, which is performed prior to applying the layer to the support.

The recording element of the invention can contain one or more conducting layers such as an antistatic layer to prevent undesirable static discharges during manufacture and printing of the image. This may be added to either side of the element. Antistatic layers conventionally used for color films have been found to be satisfactory, such as those in U.S. Pat. No. 5,147,768, the disclosure of which is hereby incorporated by reference. Preferred antistatic agents include metal oxides, e.g., tin oxide, antimony doped tin oxide and vanadium pentoxide. These antistatic agents are preferably dispersed in a film-forming binder.

The layers described above may be coated by conventional coating means onto a support material commonly used in this art. Coating methods may include, but are not limited to, wound wire rod coating, knife coating, slot coating, slide hopper coating, gravure coating, spin coating, dip coating, skim-pan-air-knife coating, multilayer slide bead, blade coating, curtain coating, multilayer curtain coating and the like. Some of these methods allow for simultaneous coatings of more than one layer, which is preferred from a manufacturing economic perspective if more than one layer or type of layer needs to be applied. The support may be stationary, or may be moving so that the coated layer is immediately drawn into drying chambers.

Ink jet inks used to image the recording elements of the present invention are well known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Example 1

(Shows Need for Water-Absorbent Polymer in the Image-Receptive Layer)

Preparation of Element 1

Preparation of the Hydrophilic, Fluid-Absorbing Layer HA-1:

A homogeneous solution was prepared from 8.25 wt. % pig-gelatin, 1.65 wt. % polyvinylpyrrolidone, PVP, (K90 from Aldrich Chemical Co.), and 1.1 wt. % of compound A-1 (see below) in distilled water, heated to 60° C. The solution was metered to a slot-die coating apparatus and coated onto a moving base support comprised of a polyethylene resin-coated photographic paper stock, chill set at 4.5° C., and dried at a temperature of 55° C. The thickness of the HA-1 layer was measured to be about 10±2 μm.

Preparation of A-1

Poly(vinylbenzyltrimethylammonium Chloride-co-divinylbenzene)

In a 250 mL three-necked, round-bottomed header flask with a stopcock at the bottom and fitted with a mechanical stirrer, 100 mL of deionized, deaerated water, 15 g of dodecyl sulfate sodium salt, 101.5 g of vinylbenzyl chloride (mixture of 3- and 4-isomers), and 16.1 g of divinylbenzene (80%; mixture of isomers) were combined under nitrogen with stirring. The resulting emulsion was pumped through the stopcock over 90 min into a heated 1 L three-necked, round-bottomed reactor flask fitted with a mechanical stirrer, reflux condenser and nitrogen inlet, and containing 365 mL of deionized, deaerated water, 5.0 g of dodecyl sulfate sodium salt, 0.06 g of sodium metabisulfite, and 0.90 g of potassium persulfate. The reaction flask was maintained at 60° C. with constant stirring over the course of the polymerization. At the end of the monomer addition, an additional 0.03 g of g sodium metabisulfite, and 0.09 g of potassium persulfate were added to the reaction flask, and the polymerization was allowed to continue for an additional 60 min. Then the contents of the flask were cooled to room temperature.

Next, a solution of 93 g of sodium hydroxide in 175 ml of deionized water was added to the stirring latex. This was followed by the addition of a solution of 180 g of trimethylamine in 200 mL of isopropyl alcohol over approximately 60 min. This stirring reaction mixture was heated at 60° C. for 24 hr. The reaction mixture was allowed to cool to room temperature and was dialyzed against deionized water to remove excess trimethylamine.

Preparation of the Open-Pore Membrane, Image-Receptive Layer:

A homogeneous solution was prepared from 6 wt. % cellulose diacetate, CDA, (CA398-30, Eastman Chemical Company), 3 wt. % polyvinylpyrrolidone, PVP, (K25 from Aldrich Chemical Co.), 2 wt. % polymer M-1 (see below), 62.3 wt. % acetone (good solvent), and 26.7 wt. % 2-methyl-2,4,-pentanediol (poor solvent). The solution was coated onto layer HA-1 using a calibrated coating knife, and dried to remove substantially all solvent components to form a microporous membrane. The thickness of the dry microporous membrane layer was measured to be about 20±2 μm.

Preparation of M-1

Compound M-1 is a water-absorbent polymer and is a random copolymer of 1-vinylimidazole and ethyl acrylate and was synthesized as follows. A 3-L three-necked, round-bottomed flask fitted with a mechanical stirrer, reflux condenser and nitrogen inlet, was charged with 1200 g of N,N-dimethyl-formamide, 193.8 g of 1-vinylimidazole, and 206.2 g of ethyl acrylate. The solution was sparged with dry nitrogen for 30 min, and then 2.0 g of 2,2'-azobis (isobutyronitrile) was added and the flask was immersed in a 60° C. constant temperature bath under a slight positive pressure of nitrogen and stirred for 24 hr. The polymer was precipitated into diethyl ether, filtered, and dried in vacuo for several days, resulting in an off-white solid.

Preparation of Element 2

This element was prepared and coated the same as Element 1 except that the dry thickness of the dry microporous membrane, image-receptive layer was measured to be about 10±2 μm.

Preparation of Element 3

This element was prepared and coated the same as Element 1 except that the dry thickness of the dry microporous membrane, image-receptive layer was measured to be about 32±2 μm.

Preparation of Element 4

Preparation of the Hydrophilic, Fluid-Absorbing Layer HA-2:

A homogeneous solution was prepared from 12 wt. % pig-gelatin in distilled water, heated to 60° C. The solution was metered to a slot-die coating apparatus and coated onto a moving base support comprised of a polyethylene resin-coated photographic paper stock, chill set at 4.5° C., and dried at a temperature of 55° C. The thickness of the HA-2 layer was measured to be about 18±2 μm.

Preparation of the Open-Pore Membrane, Image-Receptive Layer:

A homogeneous solution was prepared the same as Element 1, coated over layer HA-2 using a calibrated coating knife, and dried to remove substantially all solvent components to form a microporous membrane. The thickness of the dry microporous membrane layer was measured to be about 34±2 μm.

Preparation of Element 5

Preparation of the Hydrophilic, Fluid-Absorbing Layer HA-3:

This layer was prepared and coated the same as layer HA-2, except that the thickness of the dried layer was measured to be about 4±2 μm.

Preparation of the Open-Pore Membrane, Image-Receptive Layer:

A homogeneous solution was prepared and the same as Element 4, coated over layer HA-3 using a calibrated coating knife, and dried to remove substantially all solvent components to form a microporous membrane. The thickness of the dry microporous membrane, image-receptive layer was measured to be about 36±2 μm.

Preparation of Element 6

This element was prepared and coated the same as Element 5 except that the microporous membrane, image-receptive layer was prepared from 6 wt. % CDA, 3 wt. % PVP, (K25), 63.7 wt. % acetone, and 27.3 wt. % 2-methyl-2,4,-pentanediol, and the thickness of the dry microporous membrane, image-receptive layer was measured to be about 20±2 μm.

Preparation of Control Element C-1 (No Water-Absorbent Polymer)

A homogeneous solution was prepared from 6 wt. % cellulose diacetate, CDA, 51.7 wt. % acetone (good solvent), and 42.3 wt. % 2-methyl-2,4,-pentanediol (poor solvent). The solution was coated onto layer HA-1 using a calibrated coating knife, and dried to remove substantially all solvent components to form a microporous membrane. The thickness of the dry microporous membrane layer was measured to be about 20±2 μm.

Printing

The above elements of Example 1 were printed using an HP Photosmart® Inkjet Printer and HP Photosmart® inks. The densities were read using an X-Rite 820® densitometer. The red channel density of the cyan patch at D-max (the highest density setting) and the green channel density of the magenta patch at D-max are reported in the following Table 1. The gloss of the top surface of the unprinted image was measured using a BYK Gardner gloss meter at an angle of illumination/reflection of 60°. The results are reported in Table 1 and are referenced to a highly polished black glass with a refractive index of 1.567 that has a specular gloss value of 100.

Optical Microscopy:

The location of the cyan and magenta dye in the printed samples of each element was determined as described below and is indicated in Table 1. Thin cross-sections (about 5 microns thick) of a D-max printed area in the sample were obtained using a Spencer A/O microtome. The sections were mounted on a glass slide with a drop of immersion oil, a cover slip was placed over the oil and sections were then pressed to disperse the oil. The slide was placed on a Jenaval Universal transmission microscope. The samples were examined for ink penetration and location. Magnifications up to 2500× can be used reliably.

TABLE 1

| Element | Polymers in image-receptive layer (Wt. Ratios) | Gloss 60 degree | D-max Cyan | D-max Magenta | Dye location |
|---|---|---|---|---|---|
| 1 | CDA/ PVP/M-1 (55/27/18) | 70 | 1.84 | 1.75 | open-pore membrane layer |
| 2 | CDA/ PVP/M-1 (55/27/18) | 53 | 1.67 | 1.55 | open-pore membrane layer |
| 3 | CDA/ PVP/M-1 (55/27/18) | 50 | 1.87 | 1.66 | open-pore membrane layer |
| 4 | CDA/ PVP/M-1 (55/27/18) | 69 | 1.85 | 1.8 | open-pore membrane layer |
| 5 | CDA/ PVP/M-1 (55/27/18) | 63 | 1.86 | 1.77 | open-pore membrane layer |
| 6 | CDA/PVP (67/33) | 54 | 1.98 | 1.71 | open-pore membrane layer |
| Control C-1 | CDA (100) | 10 | 0.94 | 0.61 | HA-1 layer |

The above results show that the elements of the invention all had higher densities and surface gloss as compared to the control element. The above results also show that for all the elements of the invention, the dye is located in the open-pore membrane, image-receptive layer, rather than in the hydrophilic, fluid-absorbing layer.

Example 2

(Shows Need for at Least 25 wt. % of Water-Absorbent Polymer in the Image-Receptive Layer)

Preparation of Element 7

Preparation of the Hydrophilic, Fluid-Absorbing Layer HA-4:

This layer was prepared and coated the same as layer HA-2, except that the thickness of the dried layer was measured to be about 10±2 μm.

Preparation of the Open-Pore Membrane, Image-Receptive Layer:

A homogeneous solution was prepared from 6 wt. % cellulose diacetate, CDA, 2 wt. % polyvinylpyrrolidone, PVP, (K25), 55.2 wt. % acetone (good solvent), and 36.8 wt. % 2-methyl-2,4,-pentanediol (poor solvent). The solution was coated onto layer HA-4 using a calibrated coating knife, and dried to remove substantially all solvent components to form a microporous membrane. The thickness of the dry microporous membrane layer was measured to be about 20±2 μm.

Preparation of Element 8

This element was prepared and coated the same as Element 7 except that Polymer M-1 was added at 3 wt. %, the PVP was 3 wt. %, the acetone was 52.8 wt. % and the 2-methyl-2,4,-pentanediol was 35.2 wt. %.

Preparation of Element 9

This element was prepared and coated the same as Element 7 except that Polymer M-1 was added at 4 wt. %, the PVP was 4 wt. %, the acetone was 51.6 wt. % and the 2-methyl-2,4,-pentanediol was 34.4 wt. %.

Preparation of Control Element C-2 (Water-Absorbent Polymer Less Than 25 wt. %)

This element was prepared and coated the same as Element 7 except that the CDA was 6.4 wt. %, and the PVP was 1.6 wt. %.

Preparation of Control Element C-3 (Water-Absorbent Polymer Less Than 25 wt. %)

This element was prepared and coated the same as Element 7 except that the CDA was 6.8 wt. %, and the PVP was 1.2 wt. %.

Preparation of Control Element C-4 (Water-Absorbent Polymer Less Than 25 wt. %)

This element was prepared and coated the same as Element 7 except that the CDA was 7.2 wt. %, and the PVP was 0.8 wt. %.

Preparation of Control Element C-5 (Water-Absorbent Polymer Less Than 25 wt. %)

This element was prepared and coated the same as Element 7 except that the CDA was 7.6 wt. %, and the PVP was 0.4 wt. %.

Printing

The above elements of Example 2 were printed using an HP Photosmart® Inkjet Printer and HP Photosmart® inks. Square patches of D-max (highest dye density) were printed onto the above elements. The density of each patch was read using an X-Rite 820® densitometer. Due to dye non-uniformity and poor quality of the printed control samples, the density of a one-inch-square D-max patch was averaged out and referenced to that obtained for a print on Kodak Inkjet Photo Paper, Catalogue No.800 6298, printed under the same conditions as the elements of Example 2. The relative % density of the cyan patch is defined as:

=[(Red channel average density of element)/(Red channel average density of Kodak Inkjet Photo Paper)]×100

These values are reported in the following Table 2.

TABLE 2

| Element | Polymers in image-receptive layer (Wt. Ratios) | Total wt. % water-absorbent polymer | Relative % cyan at D-max |
|---|---|---|---|
| 7 | CDA/PVP (75/25) | 25 | 99% |
| 8 | CDA/PVP/M-1 (50/25/25) | 50 | 100% |
| 9 | CDA/PVP/M-1 (42/29/29) | 58 | 100% |
| Control C-2 | CDA/PVP (80/20) | 20 | 71% |
| Control C-3 | CDA/PVP (85/15) | 15 | 68% |
| Control C-4 | CDA/PVP (90/10) | 10 | 47% |
| Control C-5 | CDA/PVP (95/5) | 5 | 41% |

The above results show that the elements of the invention all had a higher D-max as compared to the control elements with less than 25 wt. % water-absorbent polymer.

Example 3

(Shows Improved Waterfastness With a Mordanting Polymer)

Preparation of Element 10

A homogeneous solution was prepared from 6 wt. % CDA, 3 wt. % PVP (K25), 2 wt % mordant polymer F-1 (see below), 53.4 wt. % acetone, and 35.6 wt. % 2-methyl-2,4,-pentanediol. The solution was coated onto layer HA-4 using a calibrated coating knife, and dried to remove substantially all solvent components to form a microporous membrane.

Preparation of F-1

Poly(styrene-co-1-vinylimidazole-co-1-vinyl-3-benzylimidazolium Chloride-co-1-vinyl-3-hydroxyethylimidazolium Chloride (50/35/5/10)

Poly(styrene-co-1-vinylimidazole) (50/50) was prepared in a semicontinuous solution polymerization at 54 wt. % solids in N,N-dimethylformamide (DMF) at 120° C. in a nitrogen atmosphere using Vazo 67® initiator from Du Pont Company as initiator. After a sample was removed for analysis, the remaining polymer solution was diluted to 20 wt. % in DMF to provide a stock solution for the preparation of mordant polymers.

Next, to a 1-L 3-necked round-bottomed flask equipped with a mechanical stirrer and a reflux condenser was added 625 g of the 20.0 wt. % solution of styrene-co-1-vinylimidazole in DMF. Benzyl chloride (8.0 g) was added, and the solution was stirred and heated at 100° C. under a slight positive pressure of nitrogen for 18 hr. A portion of the solution (25 g) was removed for analysis. Then, 9.7 g of 2-chloroethanol was added, and the solution was reheated with stirring at 100° C. for an additional 18 hr. The reaction mixture was cooled and the polymer was precipitated into diethyl ether with rapid stirring. The flaky precipitate was washed well with diethyl ether and dried in a vacuum oven.

Preparation of Element 11

This element was prepared and coated the same as Element 10 except that Polymer F-1 was added at 0.6 wt. %, the acetone was 54.2 wt. % and the 2-methyl-2,4,-pentanediol was 36.2 wt. %.

Preparation of Element 12

This element was prepared and coated the same as Element 10 except that Polymer F-1 was added at 0.2 wt. %, the acetone was 54.5 wt. % and the 2-methyl-2,4,-pentanediol was 36.3 wt. %.

Printing and Waterfastness Test

The above elements of Example 3 were printed as in Example 2 using an HP Photosmart® Inkjet Printer and HP Photosmart® inks. Square patches of D-max (highest dye density) were printed onto the above elements. The density of each patch was read using an X-Rite 820® densitometer. Each patch was then submersed in distilled water for 5 minutes. After this watersoak, the density of each patch was once again read using an X-Rite 820® densitometer, and the % retained dye was calculated as follows:

% retained dye=(density after water test/density before water test)×100 The results for the cyan patch and the magenta patch at D-max (the highest density setting) are reported in Table 3:

TABLE 3

| Element | Polymers (Wt. Ratios) | % retained cyan dye at D-max | % retained magenta dye at D-max | Observations after test |
|---|---|---|---|---|
| 8 | CDA/PVP/M-1 (50/25/25) | 93 | 69 | Severe dye smear |
| 10 | CDA/PVP/F-1 (55/27/18) | 90 | 84 | Minimal dye smear |
| 11 | CDA/PVP/F-1 (63/31/6) | 62 | 55 | Minimal dye smear |
| 12 | CDA/PVP/F-1 (65/33/2) | 55 | 46 | Minimal dye smear |
| Control C-1 | CDA (100) | 22 | 26 | Measured density is very low even before watersoak |

The above results show that although Elements 8, 11, and 12 of the invention have reasonable waterfastness, compared to the control element C-1, the addition of a sufficient amount of mordant polymer F-1 improves the waterfastness of the printed image even more.

Example 4

(Shows Improved Ink Dry Time With the Two Layer Structure on Non-Porous Support, Compared to a Single Layer Structure, With No Hydrophilic, Fluid-Absorbing Layer)

Preparation of Control Element C-6

The open-pore membrane, image-receptive layer solution was prepared as for Element 10 and the solution was coated onto a base support comprised of a polyethylene resin-coated photographic paper stock layer using a calibrated coating knife, and dried to remove substantially all solvent components to form a microporous membrane.

Measurement of Ink Dry Time:

A drop (about 0.5 microliter in size) of a magenta ink jet ink, prepared using a standard formulation with Dye 6 from U.S. Pat. No. 6,001,161, was placed on each element and the time that it took for this spot to become dry to the touch was measured as the "ink drying time" as shown in the following Table:

TABLE 4

| Element | Hydrophilic, fluid-absorbing layer | Ink drying time |
|---|---|---|
| 10 | HA-4 (Gelatin) | 30 seconds |
| C-6 | none | 80 seconds |

The above results show that faster ink dry times can be achieved with the two-layer element of the invention as compared to the control element having only an open-pore membrane layer on a non-porous support.

Example 5

(Shows Other Hydrophilic, Fluid-Absorbing Layer Compositions)

Preparation of Element 13

Preparation of the Hydrophilic, Fluid-Absorbing Layer HA-5:

A homogeneous solution was prepared from 5 wt. % pig-gelatin, and 5 wt. % 0.7 $\mu$m particle size barium sulfate (Blanc Fixe Micro® from Sachtleben Corporation) in distilled water, heated to 60° C. The solution was metered to a slot-die coating apparatus and coated onto a moving base support comprised of a polyethylene resin-coated photographic paper stock, chill set at 4.5° C., and dried at a temperature of 55° C. This is a filled layer but is not porous. The thickness of the HA-5 layer was measured to be about 8±2 $\mu$m.

The open-pore membrane, image-receptive layer solution was prepared as for Element 10 and the solution was coated onto layer HA-5 using a calibrated coating knife, and dried to remove substantially all solvent components to form a microporous membrane.

Preparation of Element 14

The open-pore membrane, image-receptive layer solution was prepared the same as Element 10 and the solution was coated onto a commercially available inkjet porous receiver paper containing a high amount of organic-inorganic hybrid fine particles, "Konica Photo IJ Paper QP®", catalogue No. KJP-LT-GH-15-QP PI from Konica, using a calibrated coating knife, and dried to remove substantially all solvent components to form a microporous membrane.

Printing

The above elements of Example 5 were printed as in Example 2 using an HP Photosmart (D Inkjet Printer and HP Photosmart® inks. Square patches of D-max (highest dye density) were printed onto the above elements. The density of each patch was read using an X-Rite 820® densitometer.

The location of the cyan and magenta dye in the printed samples of each element was determined by optical microscopy, as described for Element 1 above. The following results were obtained:

TABLE 5

| Element | Hydrophilic, fluid-absorbing layer | D-max Cyan | D-max Magenta | Dye location |
|---|---|---|---|---|
| 10 | HA-4 (Gelatin) | 1.57 | 1.45 | Open-pore membrane layer |
| 13 | HA5 Gelatin/barium sulfate (50/50) | 1.61 | 1.56 | Open-pore membrane layer |
| 14 | Konica QP Photo IJ ® paper | 1.71 | 1.64 | Open-pore membrane layer |

The above results illustrate that the hydrophilic, fluid-absorbing layer employed in the invention may also contain an inorganic filler.

This invention has been described with particular reference to preferred embodiments thereof but it will be understood that modifications can be made within the spirit and scope of the invention.

What is claimed is:

1. An ink jet recording element comprising a support having thereon in order:

a) a hydrophilic, fluid-absorbing layer, and b) an image-receiving layer capable of retaining an ink jet image, said image-receiving layer comprising an open-pore membrane of a mixture of two different materials, one said material being a water-insoluble polymer and the other said material being a water-absorbent polymer, said mixture containing at least 25% by weight of said water-absorbent polymer, said image-receiving layer being made by dissolving said mixture of polymers in a solvent mixture, said solvent mixture comprising at least one solvent which is a good solvent for said water-insoluble polymer and at least one poor solvent for said water-insoluble polymer, said poor solvent having a higher boiling point than said good solvent, coating the dissolved mixture on said support, and then drying to remove approximately all of the solvents to obtain said open-pore membrane.

2. The element of claim 1 wherein said hydrophilic, fluid-absorbing layer is gelatin, acetylated gelatin, phthalated gelatin, oxidized gelatin, chitosan, poly(alkylene oxide), a poly(vinyl alcohol), sulfonated polyester, partially hydrolyzed poly(vinyl acetate/vinyl alcohol), poly(acrylic acid), poly(1-vinyl pyrrolidone), poly(sodium styrene sulfonate), poly(2-acrylamido-2-methane sulfonic acid), polyacrylamide or mixtures thereof.

3. The element of claim 1 wherein said hydrophilic, fluid-absorbing layer is gelatin.

4. The element of claim 1 wherein said hydrophilic, fluid-absorbing layer contains particulates.

5. The element of claim 4 wherein said particulates comprise inorganic oxides or organic polymers.

6. The element of claim 4 wherein said particulates comprise barium sulfate, calcium carbonate, clay, silica or alumina.

7. The element of claim 1 wherein said hydrophilic, fluid-absorbing layer has a thickness of about 1 $\mu$m to about 40 μm and said image-receptive layer has a thickness of about 2 μm to about 50 μm.

8. The element of claim 1 wherein said water-insoluble polymer is a cellulose ester.

9. The element of claim 8 wherein said cellulose ester is cellulose acetate, cellulose acetate butyrate or cellulose acetate propionate.

10. The element of claim 1 wherein said water-absorbent polymer is polyvinylpyrrolidone, a vinylpyrrolidone-containing copolymer, an imidazole-containing polymer or copolymer, polyethyloxazoline or an oxazoline-containing copolymer.

11. The element of claim 1 wherein said image-receptive layer contains at least 7% by weight of a mordant comprising a polymer or copolymer containing a quaternized nitrogen moiety.

12. The element of claim 11 wherein said quaternized nitrogen moiety comprises a salt of trimethylvinylbenzylammonium, benzyldimethylvinylbenzylammonium, dimethyloctadecylvinylbenzylammonium, 1-vinyl-3-benzylimidazolium, 1-vinyl-3-hydroxyethyl-imidazolium, or 4-hydroxyethyl-1-vinylpyridinium.

13. The element of claim 11 wherein said mordant comprises poly(styrene-co-1-vinylimidazole-co-1-vinyl-3-benzylimidazolium chloride), poly(styrene-co-1-vinylimidazole-co-1-vinyl-3-hydroxyethylimidazolium chloride), poly(styrene-co-1-vinylimidazole-co-1-vinyl-3-benzylimidazolium chloride-co-1-vinyl-3-hydroxyethylimidazolium chloride), poly(vinylbenzyltrimethylammonium chloride-co-divinylbenzene), poly(ethyl acrylate-co-1-vinylimidazole-co-1-vinyl-3-benzylimidazolium chloride) or poly(styrene-co-4-vinylpyridine-co-4-hydroxyethyl-1-vinylpyridinium chloride).

14. The element of claim 1 wherein said open-pore membrane contains filler particles.

15. The element of claim 14 wherein said filler particles are silicon oxide, aluminum oxide, calcium carbonate, barium sulfate, barium sulfate/zinc sulfide or titanium dioxide.

16. The element of claim 1 wherein said open-pore membrane also contains a crosslinking agent.

17. The element of claim 1 wherein said open-pore membrane also contains a wax or a polyolefin.

18. The element of claim 1 wherein said support is poly(ethylene terephthalate), a polyolefin-coated or a polyolefin-laminated paper.

19. The element of claim 1 wherein said good solvent is a ketone, ethyl acetate or methylene chloride and said poor solvent is an alcohol, a glycol, a xylene, cyclopentane, cyclohexane or water.

* * * * *